United States Patent [19]

Piet

[11] Patent Number: 4,619,285

[45] Date of Patent: Oct. 28, 1986

[54] FLUID FLOW CONTROL DEVICE

[75] Inventor: Meyer Piet, Arcadia, Calif.

[73] Assignee: Futurecraft Corporation, Industry, Calif.

[21] Appl. No.: 503,096

[22] Filed: Jun. 10, 1983

[51] Int. Cl.[4] ..... F16K 13/04

[52] U.S. Cl. ..... 137/68.2; 137/69; 137/71; 137/484.6; 137/505.18; 251/231; 222/3

[58] Field of Search ..... 137/68 R, 68 A, 69, 137/71, 67; 251/231; 222/3

[56] References Cited

U.S. PATENT DOCUMENTS

| | | | |
|---|---|---|---|
| 2,888,025 | 5/1959 | Greenwood | 137/71 |
| 3,010,520 | 11/1961 | Seaberg | 137/68 R X |
| 3,017,894 | 1/1962 | Chilcoat | 137/69 |
| 3,209,937 | 10/1965 | Hirst | 137/69 X |
| 3,547,404 | 12/1970 | Blackburn | 251/231 |
| 3,647,109 | 3/1972 | Hebblethwaite | 137/69 X |
| 4,243,069 | 1/1981 | Piet | 137/505.18 X |
| 4,245,660 | 1/1981 | Rozuiecki | 137/68 R X |

*Primary Examiner*—Harold W. Weakley
*Attorney, Agent, or Firm*—James E. Brunton

[57] ABSTRACT

A compact, light weight fluid flow control device adapted to be interconnected between a source of fluid under pressure and a normally stowed inflatable system such as a safety slide or flotation unit. The device uniquely initiates fluid flow between the source and the inflatable system by means of either a pyrotechnic device or a redundant mechanical system. Once fluid flow has been initiated, the device uniquely regulates and controls the flow of fluid toward the inflatable system.

4 Claims, 6 Drawing Figures

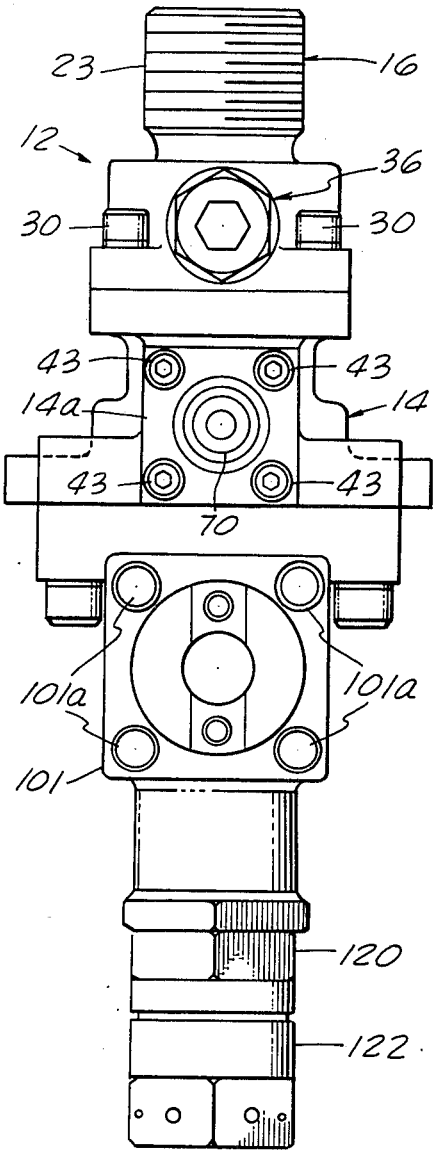
FIG. 5.
FIG. 6.
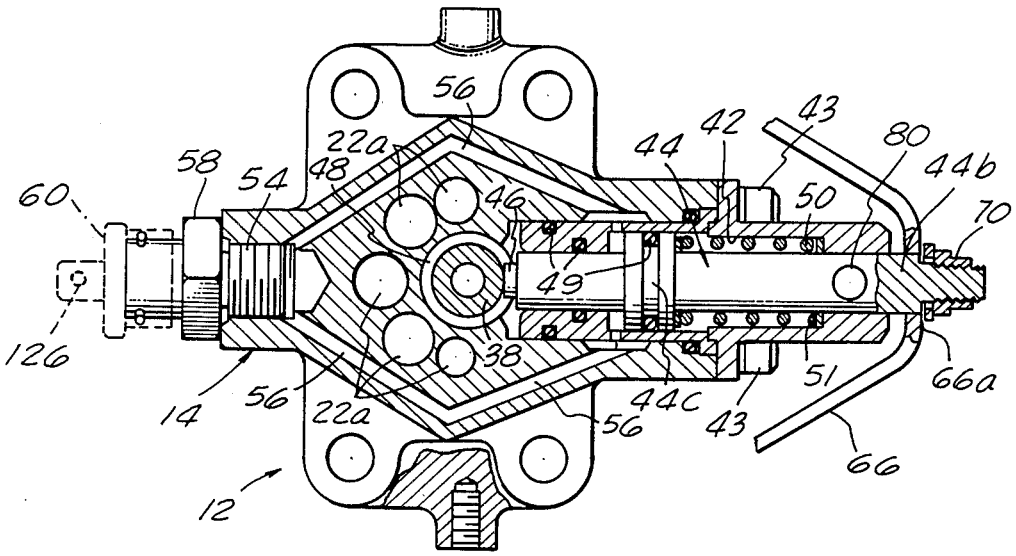

FLUID FLOW CONTROL DEVICE

BACKGROUND OF THE INVENTION

1. Field of the Invention

The present invention relates generally to fluid valving and pressure regulation apparatus and more particularly concerns a new and improved high pressure safety valving and pressure regulation apparatus adapted to be interconnected between a source of fluid under pressure and a normally stowed inflatable system such as a flotation system, an escape slide and the like. When the appartus of the invention is actuated fluid will be permitted to flow from the pressurized source toward the inflatable system at a controlled pressure.

2. Background of the Invention

Inflatable systems adapted for use in military and commercial aircraft such as escape slides and flotation devices have come into wide use in recent years. Additionally, many different types of inflatable systems have been suggested for use as safety devices in aeorspace, marine and automotive applications. Typically, the inflatable component of the system is stored in a deflated condition and is inflated only in times of emergency. Most often the inflatable component of the system is automatically inflated by various types of gases under pressure, but other fluids are also used.

The inflatable system, be it a safety slide, a flotation unit, an airbag device, or the like, typically includes the inflatable component, a source of fluid under high pressure connected to the inflatable component and a control mechanism to initiate and control the flow of fluid from the high pressure source into the inflatable component. It is the control mechanism of this type of system to which the present invention is directed.

The prior art is replete with numerous types of high pressure valves, flow regulators, pressure measuring devices and the like. However, the design of control devices for use in inflatable systems of the type presently under consideration presents unique and difficult problems. First of all the control device must be compact, light weight, rugged and easy to install and use. Secondly it must operate without fail in time of emergency, but must not be susceptible to accidental actuation. Preferably it must include both a primary and a secondary, or backup, actuation mechanism. Additionally, following actuation of the device it must positively and reliably control the pressure of the fluid flowing toward the inflatable component of the system. Finally, it must be absolutely safe for use in aircraft and other critical applications and must be readily serviceable in the field.

The present inventor is unaware of any single control device which meets the requirements set forth in the preceding paragraphs. Exemplary of a novel and useful prior art squib actuated valve is that disclosed in U.S. Pat. No. 3,017,894, which patent is owned by the assignee of the present invention. Of the various prior art pressure regulator devices which have proved practical in use, the device disclosed in U.S. Pat. No. 4,243,069, which issued to the present inventor, is perhaps the most pertinent to the invention disclosed herein. However, neither of these devices is capable of independently performing the task required of the device of the present invention.

As will become apparent from the discussion which follows, the present invention for the first time uniquely combines into a single, integral unit the capability of both initiating fluid flow from a pressurized source and then precisely regulating the flow of the fluid under pressure as it flows through the device toward the outlet part thereof. As designed, the device is virtually fail safe and incorporates several unique safety features which makes it highly reliable for use in many critical applications.

SUMMARY OF THE INVENTION

It is an object of the present invention to provide a fail safe fluid flow control apparatus for use in connection with a source of fluid under high pressure for initiating and then precisely controlling the flow of fluid from the source.

It is another object of the invention to provide an apparatus of the aforementioned character which can be acutated either mechanically or through the use of a pyrotechnic device.

Another object of the invention is to provide an apparatus as described in the previous paragraphs which is self-contained, compact and lightweight and is ideally suited for use in safety systems having inflatable components such as flotation devices, safety slides and the like.

Still another object of the invention is to provide an apparatus of the character described which is entirely safe in use even in critical aircraft and aerospace applications and is virtually immune from accidental actuation as a result of dropping the apparatus, objects falling of the device, unauthorized tampering, or exposure to hostile environments.

A further object of the invention is to provide a unique fluid flow control apparatus which can be safety actuated by a small pyrotechnic device and one which further includes a redundant, positively acting mechanical override back-up actuation system.

Another object is to provide a device as described in the preceding paragraph in which the actuation device is specially designed so that a predetermined minimum amount of force must be exerted on the manual actuation mechanism to actuate the device.

Another object of the invention is to provide an apparatus of the class described in which the fluid flow regulation system of the device is highly reliable, extremely responsive and stabilizes very rapidly at optimum downstream regulated pressure without hunting.

Yet another object of the invention is to provide a control apparatus which is of simple design, is easy to install, is contamination free and is readily serviceable in the field.

Another object of the invention is to provide an apparatus of the character described in the preceding paragraphs which can be inexpensively manufactured in large quantities and can be used for a wide variety of applications in both high and low pressure fluid applications.

BRIEF DESCRIPTION OF THE DRAWINGS

FIG. 5 is an end view of the device looking toward the right side of the device as it is illustrated in FIG. 2.

FIG. 6 is a cross-sectional view taken along lines 6—6 of FIG. 4.

DESCRIPTION OF ONE FORM OF THE INVENTION

Figure 1:
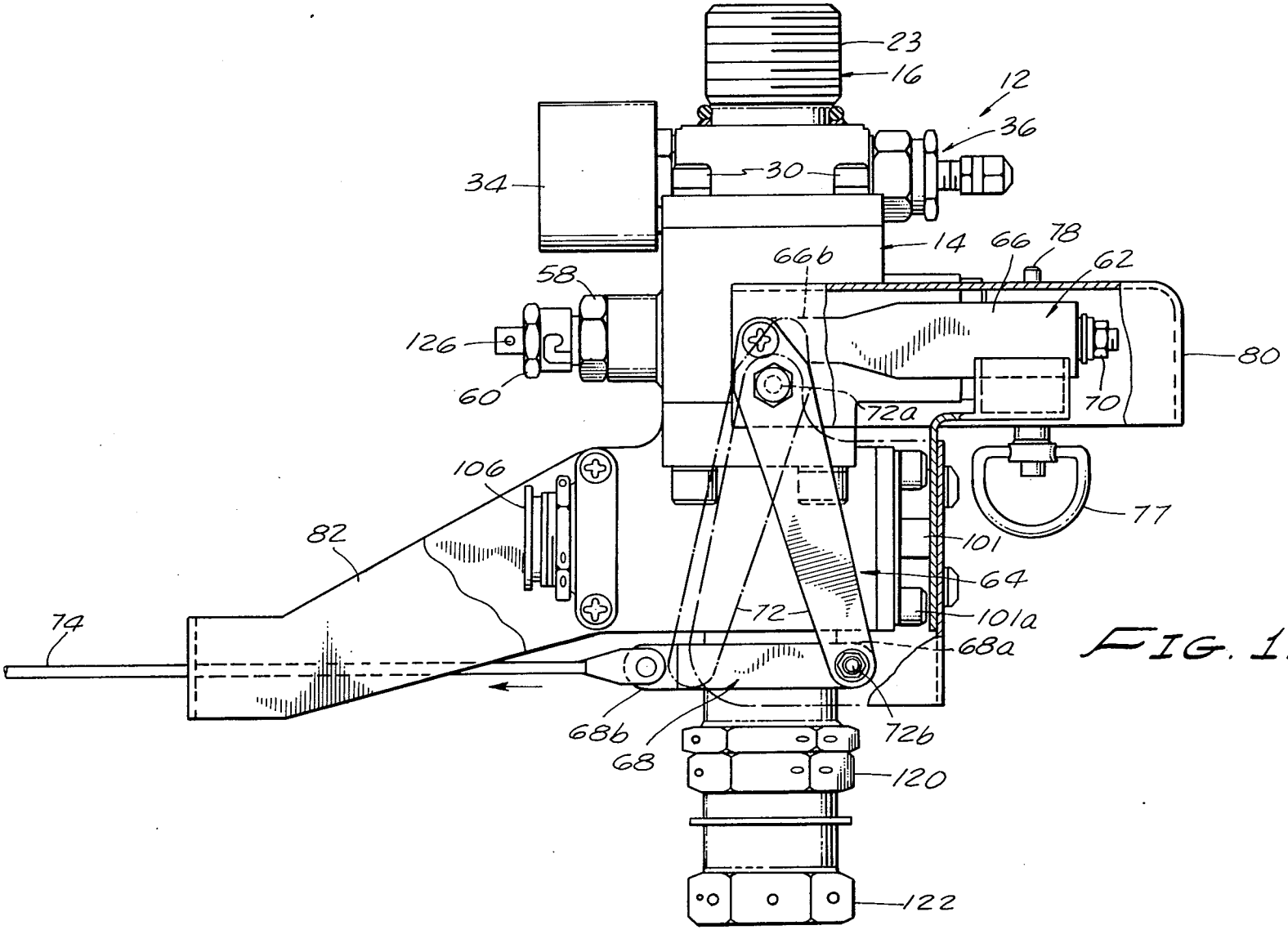
FIG. 1 is a side elevational view of the Fluid Flow Control Device of the invention.
Figure 2:
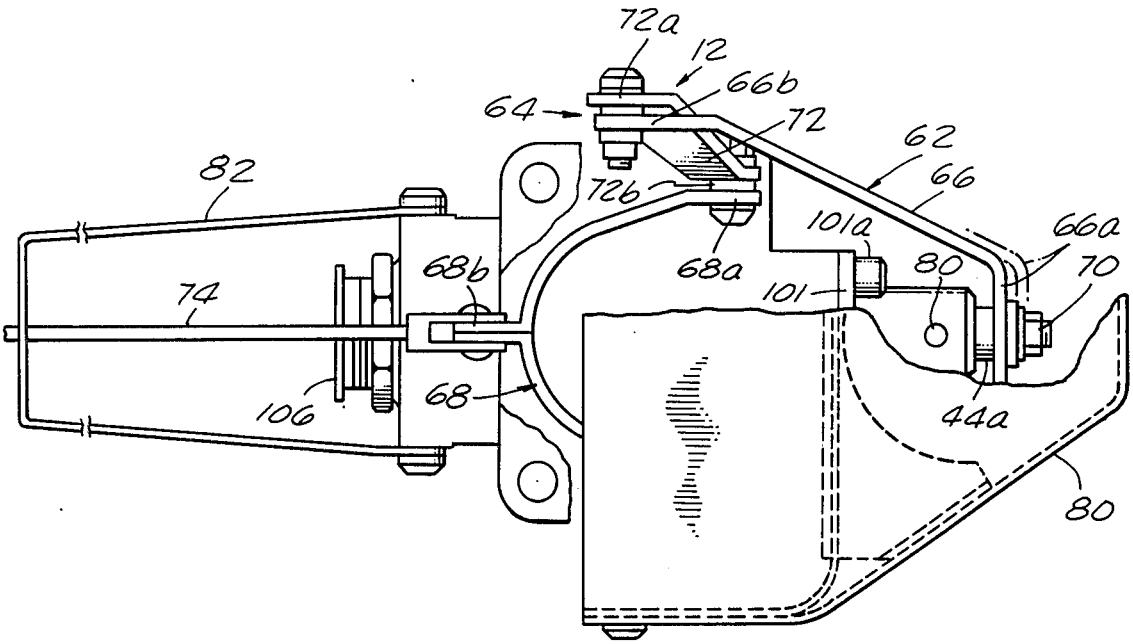
FIG. 2 is a bottom view of the device partly broken away to illustrate the configuration of the mechanical actuating mechanism of the device.

Referring to the drawings, and particularly to Figures 1 through 4, the Fluid Flow Control Device of the present invention, which is generally indicated in the drawings by the numeral 12, is adapted to be interconnected between a container such as a gas bottle containing a fluid at high pressure and an inflatable device such as a flotation unit, an escape slide or the like. In the manner described hereinafter, the control device functions in a unique manner to initiate and control the flow of fluid between the high pressure container and the inflatable device.

Figure 4:
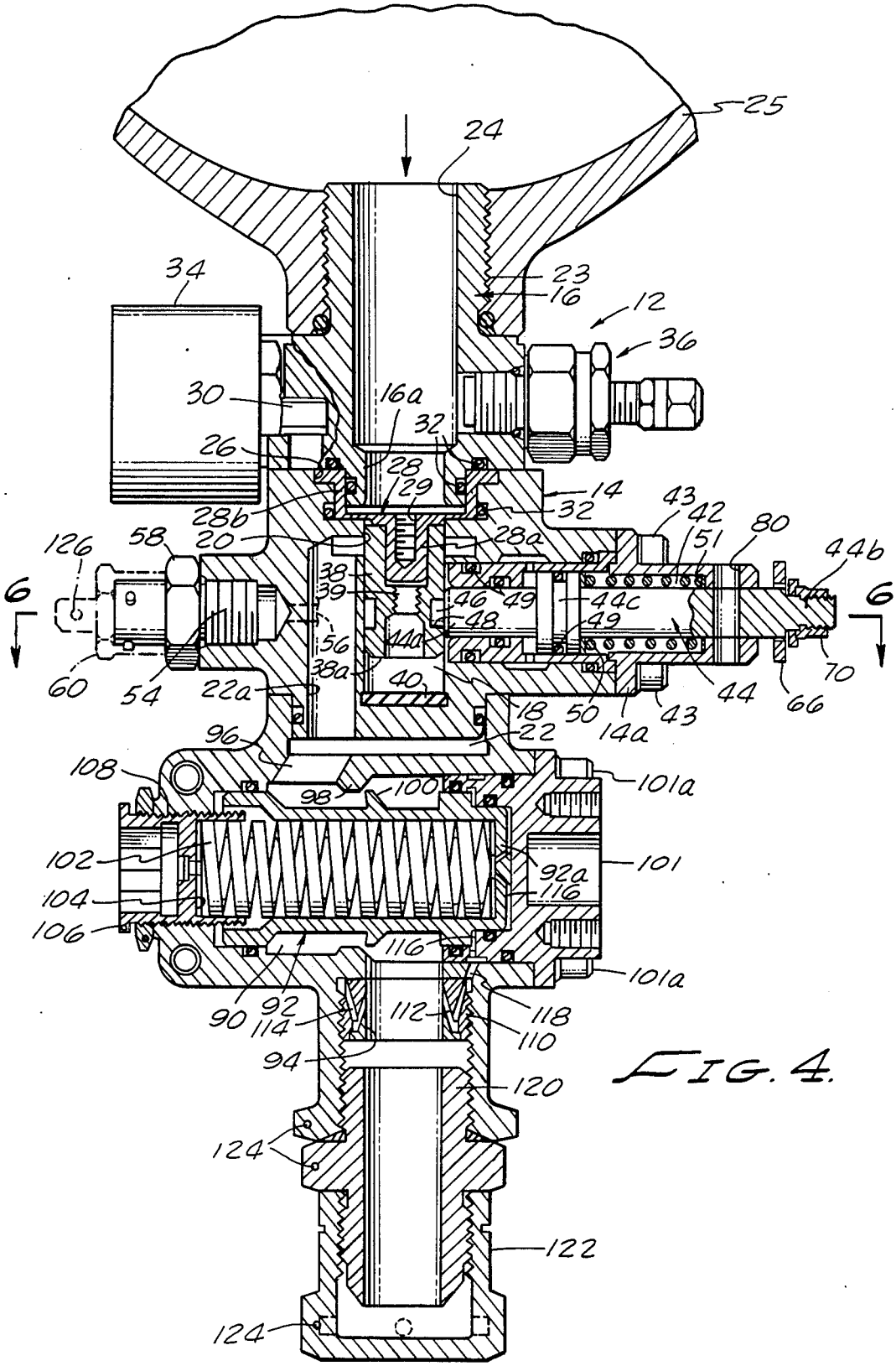
FIG. 4 is a cross-sectional view taken along lines 4—4 of FIG. 3 showing the internal construction of the device.

In the embodiment of the invention shown in the drawings, the fluid flow control device comprises a multi-chambered body 14, connector means in the form of an externally threaded connector element 16 adapted to interconnect body 14 with the high pressure fluid container, actuating means for initiating the flow of fluid under pressure from the container and regulation means for precisely controlling the flow of fluid through body 14 and into the inflatable unit to which the device is interconnected. Referring particularly to FIG. 4, body 14 includes a first chamber 18 having a fluid inlet 20 and a fluid outlet 22. Connector element 16 is externally threaded at 23 for interconnection with the high pressure fluid container and is internally bored to form a fluid inlet passageway 24. Passageway 24 is adapted to communicate with the inlet 20 of first chamber 18 and also to communicate with the fluid outlet of the container 25 (shown in phantom lines in FIG. 4) so that fluid under pressure from the container can flow in the direction of the arrow of FIG. 4 from the container into first passageway 24.

Figure 3:
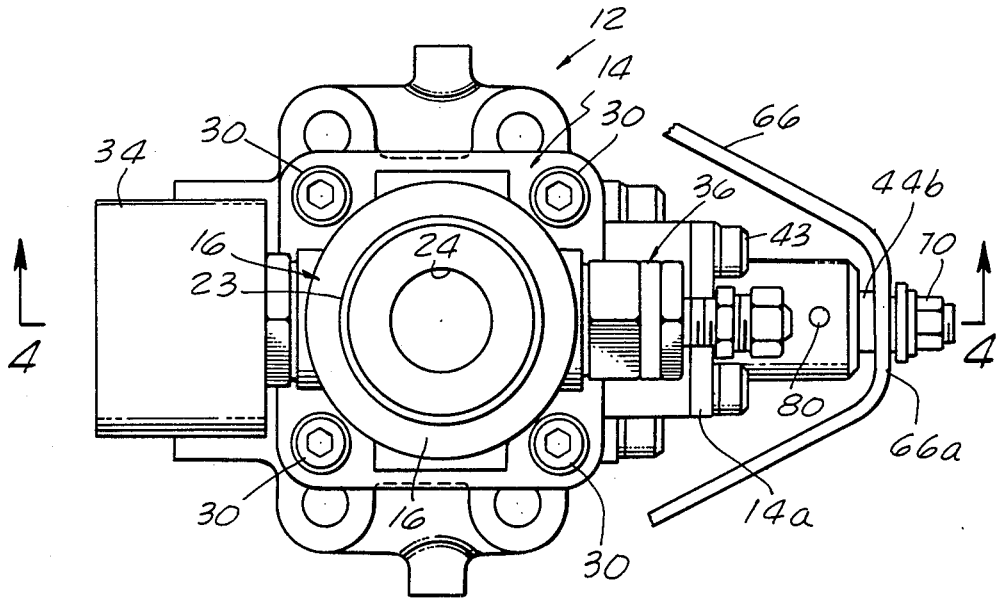
FIG. 3 is a plan view of the main body portion of the device and a portion of the actuating mechanism.

Body 14 is counter bored at 26 to removably receive a frangible, or shearable, diaphragm 28 which is securely held in position within body 14 by connector element 16 which, in turn, is removably connected to body 14 by threaded fasteners 30 (FIG. 3). Diaphragm 28 includes a downwardly depending central portion 28*a* and an upstanding peripheral portion 28*b*. The diaphragm is constructed of a thin, but rigid metal such as aluminum having a central portion adapted to shear upon being subjected to a predetermined loading. Accordingly, central portion 28*a* is internally threaded at 29 to receive a removal wrench adapted to remove the diaphragm from the device after it has been sheared. To prevent fluid leakage around the diaphragm when it is clamped in position within body 14, three elastomeric O-rings are retained within grooves formed in connector element 16 and in body portion 14 to engage the diaphragm 28 in the manner shown in FIG. 4. Also forming a part of the connector means of the present form of the invention is pressure measuring means shown here in the form of a pressure gauge 34 of standard design which is threadably interconnected with connector element 16 for communication with passageway 24 for measuring the pressure of the fluid in passageway 24 and within the pressurized container 25. Positioned opposite pressure gauge 34 is a charging means provided in the form of a charging valve assembly 36 for permitting fluid under pressure to be introduced from an external source into the pressurized container. Charging valve assembly 36 which is threadably received in the wall of connector element 16, is of standard design and is readily interconnectable with a source of fluid under pressure.

Disposed within first chamber 18 intermediate fluid inlet 20 and fluid outlet 22 is a support spool or poppet 38. Spool 38 is reciprocally movable within chamber 18 from a first position, as shown in FIG. 4, to a second position wherein the lower face 38*a* of the spool is in engagement with a resilient bumper pad 40 disposed in the bottom of first chamber 18. When spool 38 is in the first position shown in FIG. 4, it is adapted to reinforce the central thin wall portion of diaphragm 28 against pressurized fluid in passageway 24 and in the pressurized container 25. However, when the spool 38 is moved into its second position, and out of supporting engagement with the diaphragm, the design of the frangible diaphragm is such that the pressure within the pressurized container acting on the upper surface of the diaphragm will cause the diaphragm to shear allowing fluid to flow from passageway 24 through inlet 20 into chamber 18. The fluid flowing under pressure into chamber 18 will move spool 38 into its second lower position and the fluid will then flow through fluid passageways formed in the valve body and then through outlet 22. As best seen by referring to FIG. 6, a plurality of fluid passageways 22*a* are bored in body 14 to permit the free flow of fluid toward fluid outlet 22.

A second chamber 42, which extends generally perpendicularly to chamber 18 is formed in a bushing assembly 14*a* which forms a part of body 14. As seen in FIGS. 4 and 5, assembly 14*a* is held in position by threaded fasteners 43. Reciprocally movable within chamber 42 is a piston 44 having first and second end portions 44*a* and 44*b* respectively and an enlarged diameter centrally located portion 44*c*. Provided at first end 44*a* of the piston is an outwardly protruding locking boss 46. When piston 44 and spool 38 are both in their first position as shown in FIG. 4, locking boss 46 is adapted to be closely received within a groove 48 formed in spool or poppet 38. In this position spool 38 is positively and securely locked in place by piston 44 with the upper portion of the spool in supporting engagement with the lower face of shearable diaphragm 28. Piston 44 is continuously urged toward the first position shown in FIG. 4 by a biasing means shown here in the form of a yieldably deformable coil spring 50 disposed within chamber 42 with one end thereof in engagement with the central portion of piston 44 and the other in engagement with an internal shoulder 51 formed in bushing assembly 14*a*.

Preferably piston 44 is constructed of a heat treated steel and bushing 14*a* is constructed of an aluminum-bronze material which exhibits a low coefficient of friction in combination with heat treated steel. Locking boss 44*a* is precision machined to provide positive and highly reliable locking engagement with spool 38 which is also precision machined from a material such as stainless steel. Elastomeric O-rings 49 are carried within grooves formed in the bushing assembly and in the piston to prevent fluid leakage to the exterior of body 14.

An important aspect of the present invention comprises the actuation means for moving piston 44 from the first position shown in FIG. 4 to a second position wherein locking boss 46 is moved out of supporting engagement with spool 38 so that the spool is free to move downwardly out of engagement with diaphragm 28. In the present embodiment of the invention, the actuation means comprises both mechanical and pyrotechnic means for accomplishing the controlled movement of the piston 44 within chamber 42. The pyrotechnic means is carried by body 14 proximate a fourth chamber 54 which is interconnected with chamber 42 by a pair of fluid passageways 56 formed internally of body 14 (see FIG. 6). With this construction, when the pyrotechnic means is ignited the explosive gases generated thereby will flow through passageways 56 toward chamber 42. As best seen in FIG. 6, passageways 56 are constructed so that the explosive gases from the pyrotechnic means will impinge upon the central portion 44*c* of piston 44 to cause the piston to move from its first position to its second retracted position freeing spool 38 for movement within chamber 18.

The pyrotechnic means in the present embodiment of the invention is provided in the form of a standard pyrotechnic device 58 which is threadably received within fourth chamber 54. Pyrotechnic device 58 comprises an internally disposed electrically activated pyrotechnic cartridge and a Faraday safety cap 60. The pyrotechnic device is of a standard construction well understood by those skilled in the art. Since the device itself forms no part of the present invention, the details of its construction will not be described herein.

The mechanical means, which also comprises a part of the actuation means of the present invention, act as a manual override and back-up to the pyrotechnic means. These mechanical means are carried externally of body 14 and are generally designated in FIGS. 1 and 2 by the numeral 62. In the form of the invention thereshown, the mechanical actuation means comprises an actuating arm assembly 64 and first and second U-shaped members 66 and 68 respectively. The bight portion 66*a* of member 66 is apertured so that it can be received over and be operably interconnected to end 44*b* of piston 44. For this purpose, end 44*b* of piston 44 is externally threaded to receive a lock nut and washer assembly 70 adapted to locate member 66 in a predetermined position with respect to piston 44. The actuating arm assembly 64 comprises a pair of spaced apart arms 72 which are pivotally connected at one end 72*a* to the spaced apart free ends 66*b* of U-shaped member 66 and are pivotally connected at their opposite ends 72*b* to the spaced apart free ends 68*a* of U-shaped member 68. As illustrated in FIG. 1, an elongated actuating cable 74 is connected to the bight portion 68*b* of member 68 for causing movement of member 68 in the direction of the arrow of FIG. 1.

With the construction of the mechanical actuation means as described in the preceding paragraph, a force tending to pull cable 74 to the left as viewed in FIG. 1 will cause actuating arms 64 to move a substantial distance from the position shown in the solid lines in FIG. 1 into the position shown in the phantom lines in FIG. 1. This movement of arm 64 will cause a much smaller but highly positive proportional movement of U-shaped member 66 to the right as viewed in FIG. 1. Movement of member 66 will, of course, cause a simultaneous movement of piston 44 to which it is interconnected by connector assembly 70. This rather small movement of piston 44 to the right will cause locking boss 46 to move out of supporting engagement with poppet 38, thereby removing support to the diaphragm 28 so as to permit fluid to flow from the container into chamber 18. The substantial mechanical advantage of the actuating assembly is obvious from a study of FIG. 1.

To positively prevent accidental actuation of the device, safeing means are provided in the form of a safety pin lock assemblage 77 having an elongated shaft 78 adapted to be received in and extend through a transverse bore 80 formed in body insert 14*a* and piston 44 (FIGS. 1 and 4). With locking pin assembly 77 in position as shown in FIG. 1, any movement of piston 44 from its first position to its second position will be positively prevented. Only after the safety pin lock is removed can the device be actuated either by the pyrotechnic device or by the mechanical actuation means.

To protect the actuation apparatus of the device, a shroud 80 is provided to cover the actuation portion of the device and prevent damage thereto by objects falling on the device or by the device being dropped accidentally. To further protect the actuation device, and to prevent accidental actuation, a cable attach bracket 82 is affixed to body portion 14 for the purpose of protecting the cable and for acting as a guide for the travel of the cable 74.

Another important aspect of the control device of the present invention comprises fluid flow regulation means for regulating the flow of fluid between the outlet 22 of chamber 18 and the outlet of the control device which is in communication with the unit to be inflated. Referring to FIG. 4, the regulation means in the embodiment of the invention thereshown comprises a third chamber 90 formed within body 14 and a valve member 92 reciprocally movable within chamber 90 from a first position to a second position in response to fluid pressure exerted thereon. Third chamber 90, has a fluid outlet 94 and a fluid inlet 96 in communication with fluid outlet 22 of chamber 18. Formed intermediate the walls of the device which define chamber 90 is a circumferentially inwardly extending shoulder 98. Shoulder 98, which is located intermediate the fluid inlet and the fluid outlet of chamber 90 is adapted to cooperate with a circumferentially outwardly extending protuberance 100 formed on member 92 intermediate its ends. When valve member 92 is in the position shown in FIG. 4, fluid is free to flow from outlet 22 of chamber 18 into inlet 96 through chamber 90 and outwardly through outlet 94. However, movement of valve member 92 from its first position shown in FIG. 4 to a second position to the left of that shown in FIG. 4 will cause protuberance 100 to move into engagement with shoulder 98 thereby inhibiting further flow of fluid from inlet 96 to outlet 94. Chamber 90 is closed at its right end as viewed in FIG. 4 by member 101 which is secured by body 14 by threaded fasteners 101*a*.

To retain valve element 92 in its normally open position shown in FIG. 4, there is provided biasing means for yieldably resisting movement of the valve element from the first position to the second position. In the present embodiment of the invention, this biasing means is provided in the form of a spring member 102 which is disposed internally of valve element 92 and is adapted to act against a shoulder 104 formed on an insert member 106 which is threadably received within an internally threaded bore 108 provided in body 14 proximate one end of chamber 90. Insert member 106, which comprises the regulator pressure adjustment means of this form of the invention, enables adjustment of the force exerted by the spring against the valve element. By threadably adjusting insert member 106 longitudinally of bore 108, the force of spring 102 acting upon valve member 92 can be precisely adjusted thereby regulating the fluid pressure required to move the valve member within chamber 90.

To control the movement of valve member 92, there is provided fluid diverting means disposed within outlet 94 of third chamber 90. This fluid diverting means comprises an externally threaded member 110 adapted to be received within internally threaded outlet portion 94 of chamber 90. Formed within the side walls of insert member 110 are angularly extending fluid passageways or conduits 112 and 114. Due to the location and novel configuration of member 110, passageway 112 functions to reliably capture a determinable portion of the fluid flowing through the outlet passage 94 and to efficiently direct it toward a fluid pressure chamber 116 through passageways 114 formed in member 110 and passageway 118 formed in body portion 14. Fluid under pressure within chamber 116 will exert a force on valve member 92 causing the member to move to the left as viewed in FIG. 4 toward a closing position against the urging of spring 102.

The greater the resistance offered by spring 102 to movement of valve member 92, the greater will be the fluid pressure required to move the member toward its second, or closure, position. As previously discussed, this resistance can be adjusted by threading insert member 106 inwardly or outwardly of body portion 14.

During storage and prior to interconnecting the device of the invention to the inflatable unit, safety cap means are provided to close outlet passageway 94. These means comprise an externally threaded member 120 which is threadably received within outlet chamber 94 and a cooperating closure cap 122 which is threadably connected to member 120. Seal wire apertures 124 are provided in members 120, 122 and in body 14 to receive protective seals adapted to prevent tampering. Similarly, a seal wire aperture 126 is provided in the pyrotechnic means so that a seal can be used to simultaneously interconnect the safety cap means, the pyrotechnic means and the safety locking pin 77.

OPERATION

With the Fluid Flow Control Device of the invention connected to a pressurized fluid source, such as a gas storage bottle, the bottle pressure can be observed on pressure gage 34. Normally, the gage is temperature compensated to give an accurate reading of plus or minus 100 psi in the critical charging range of 1700 psig to 3900 psig for the gas mixture, for example, of 70% GN2 and 30% CO2. If the pressure in the bottle is below this range, additional gas mixture can be introduced into the bottle through the charging mechanism 36.

The control device of the instant form of the invention is capable of operation either through electrical activation of the pyrotechnic device 58 or by means of the redundant, manually operated lanyard such as cable 74. Either mode of operation results in the removal of the support provided to the thin aluminum diaphragm 28 by spool 38, allowing bottle pressure to shear the diaphragm permitting gas to flow through the regulator and out the outlet 94.

In pyrotechnic operation, the hot gases generated by the pyrotechnic device, or squib 58 are discharged through two redundant passages 56 formed within the valve body 14 and are directed under the circumferential shoulder formed on piston 44. This causes the piston to move outward, against the force of spring 50 thereby removing the support of the spool 38 from under the shearable diaphragm. When this support is removed the thin aluminum diaphragm 28 can no longer withstand the nominal 3000 psig bottle pressure and shears completely, leaving about a 0.625 inch diameter hole for the gas to escape and flow through the regulator portion of the device and out the outlet.

When the device is actuated manually, the same result is achieved by pulling on the cable 74 which causes the piston 44 to move outward by means of forces generated by the mechanical actuation arm assembly. The spring 50 acting on the piston maintains it in locking engagement with the spool 38, insuring positive support of the diaphragm, and insuring that the device will not actuate until a pulling force of at least about six pounds is exerted on the cable 74. However, the design of the spring is such that at a maximum of about 10 pounds pull on the cable the piston will move away from the support spool and shearing of the diaphragm will occur.

To prevent inadvertent actuation from falling objects or dropping of the control device, the shroud 80 is provided to protect the mechanism and a safety locking pin 77 locks the piston in position in locking engagement with the support spool.

In constructing the diaphragm 28, an aluminum forging of 2014 material has proven satisfactory. This forging, from which the diaphragm is precision machined, insures proper grain flow in the critical areas and practically eliminates the possibility of leakage through the material. Additionally, tests have shown that shearing of diaphragms made from this material does not generate contamination harmful to either the downstream regulator or to the inflatable unit to which the device is connected.

Once the diaphragm has been sheared, gas flows freely through the passages **22*a* formed in the body 14, through chamber 90 and thence to outlet 94 of the device. The gas pressure at the outlet 94 is sensed by the valve member 92 through the previously described, specially designed fitting 110 which is installed in the outlet port 94. This sensed pressure causes the valve member 92 to move against the spring 102 until a force balance position is obtained. If the outlet pressure decreases the valve member moves so as to open the seat or valve closure area allowing more fluid flow. The reverse occurs if the outlet pressure gets too high. The force exerted by spring 102 is adjustable by means of insert 106 provided on one end of body 14** and allows adjustment of the outlet pressure nominally up to 900 psig.

To aid in the removal of the sheared diaphragm 28 and the associated support spool 38, internal threads 29 and 39 are provided on each component to accept an externally threaded removal tool.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A fluid flow control device adapted to be interconnected between a container containing a gas at high pressure and an inflatable device for controlling the flow of gas therebetween, said control device comprising:

(a) a body including a first chamber having a fluid inlet and a fluid outlet and a pair of explosive gas flow passageways, each having first and second ends;

(b) connector means adapted to interconnect said body with the container, said means including a fluid inlet passageway adapted to communicate with said first chamber and with the fluid outlet of said container;

(c) a support spool disposed within said first chamber intermediate said fluid inlet and said fluid outlet said spool being reciprocally movable within said first chamber from a first position to a second position;

(d) a shearable diaphragm removably located between said connector means and said body for normally preventing fluid flow between said container and said fluid inlet of said first chamber, said spool being adapted to reinforce said diaphragm against pressurized fluid in said container when said spool is in said first position;

(e) a second chamber formed within said body proximate said first chamber and extending generally perpendicular with respect thereto, said second chamber being in communication with said first ends of said explosive gas flow passageways of said body;

(f) a piston reciprocally movable within said second chamber from a first position to a second position, said piston having first and second ends and including a locking boss protruding from said first end adapted to engage a shoulder formed on said support spool when said piston is in its first position whereby said spool is maintained in said first position in supportive engagement with said diaphragm, said piston also having an enlarged diameter central portion defining first and second spaced apart radially outwardly extending shoulders;

(g) actuation means carried by said body for moving said piston from said first position to said second position whereby said locking boss will move out of engagement with said shoulder and pressurized fluid within said inlet will act to shear said diaphragm to permit fluid to flow out said fluid outlet, said actuation means comprising:

(1) pyrotechnic means carried by said body proximate said second chamber for interaction with said piston to urge movement thereof toward said second position, said pyrotechnic means being in communication with said second ends of said explosive gas passageways formed in said body; and (2) mechanical means carried by said body for moving said piston from said first position to a second position;

(h) a third chamber formed within said body having a fluid outlet and a fluid inlet in communication with said fluid outlet of said first chamber;

(i) a circumferentially inwardly extending shoulder formed within said third chamber intermediate said fluid inlet and said fluid outlet;

(j) a valve member reciprocally movable within said third chamber from a first position to a second position in response to fluid pressure exerted thereon, said member including a circumferentially outwardly extending protuberance for engagement with said shoulder when said valve member is moved to said second position to prevent fluid flow between said inlet and outlet of said third chamber;

(k) first biasing means operably associated with said valve member for yieldably resisting movement thereof from said first position to said second position;

(l) second biasing means for yieldably resisting movement of said piston from said first position to said second position; and (m) fluid diverting means disposed within said outlet of said third chamber for diverting a portion of the fluid flowing therethrough and directing it toward said valve member to urge movement thereof toward said second position;

whereby when said pyrotechnic means is ignited, explosive gases will flow through said pair of explosive gas flow passageways and said explosive gas will impinge upon said first shoulder of said piston urging said piston toward said second position against the urging of said second biasing means.

2. A fluid flow control device as defined in claim 1 in which said biasing means comprises a coil spring carried within said second chamber one end of said spring being in engagement with said second shoulder of said piston.

3. A fluid flow control device as defined in claim 1 in which said second end of said piston protrudes from said body and in which said mechanical means comprises an actuating arm assembly and a first U-shaped member including a bight portion adapted to be removably interconnected to said second end of said piston, said first U-shaped member being movable by said actuating arm assembly from a first position to a second position to move said piston within said second chamber against the urging of said biasing means.

4. A fluid flow control device as defined in claim 3 in which said actuating arm assembly comprises a second U-shaped member; a pair of spaced apart arms pivotally connected at one end to said first U-shaped member and at their opposite end to said second U-shaped member; and cable means attached to said second U-shaped member.

* * * * *